US005987914A

United States Patent [19]

Sumida et al.

[11] Patent Number: 5,987,914

[45] Date of Patent: Nov. 23, 1999

[54] REFRIGERATING/AIR-CONDITIONING APPARATUS

[75] Inventors: Yoshihiro Sumida; Masahiro Nakayama; Sou Suzuki; Isao Funayama; Kunihiro Morishita, all of Shizuoka, Japan

[73] Assignee: Mitsubishi Denki Kabushiki Kaisha, Tokyo, Japan

[21] Appl. No.: 09/087,859

[22] Filed: Jun. 1, 1998

[30] Foreign Application Priority Data

Aug. 19, 1997 [JP] Japan ..... 9-222139
Dec. 25, 1997 [JP] Japan ..... 9-357314

[51] Int. Cl.[6] ..... F25B 43/02

[52] U.S. Cl. ..... 62/468

[58] Field of Search ..... 62/84, 114, 468

[56] References Cited

U.S. PATENT DOCUMENTS 5,419,144 5/1995 Kawaguchi et al. .
5,517,824 5/1996 Konishi et al. .
5,531,080 7/1996 Hirahara et al. .

FOREIGN PATENT DOCUMENTS 5-157379 6/1993 Japan .
7-208819 8/1995 Japan .
8-41448 2/1996 Japan .

*Primary Examiner*—Henry Bennett
*Assistant Examiner*—Malik N. Drake
*Attorney, Agent, or Firm*—Burns, Doane, Swecker & Mathis, LLP

[57] ABSTRACT

In a refrigeration cycle using a cooling medium circuit in which a compressor, a heat-source-side heat exchanger, a decompressor, and a user-side heat exchanger are connected successively for circulating a cooling medium, and refrigerating machine oil having no or extremely low mutual solubility to the cooling medium; an internal diameter of a down comer in which a liquid phase cooling medium flows from the upstream side to the down stream side in the refrigeration cycle is adjusted so that the flow velocity of cooling medium in the down comer is made to be higher than that at which refrigerating machine oil floating in a cooling medium goes down.

15 Claims, 9 Drawing Sheets

REFRIGERATING/AIR-CONDITIONING APPARATUS

FIELDS OF THE INVENTION

The present invention relates to a refrigerating/air-conditioning apparatus using refrigerating machine oil having no or extremely low mutual solubility to a cooling medium for returning the refrigerating machine oil discharged from a compressor into a cooling medium circuit to the compressor.

BACKGROUND OF THE INVENTION

FIG. 11 is a circuit diagram for a cooling medium showing a refrigerator as a conventional type of refrigerating/air-conditioning apparatus disclosed in, for example, Japanese Patent Laid-Open Publication No. HEI 5-157379. In the figure, designated at the reference numeral 1 is a compressor, at 2 a heat-source-side heat exchanger, at 3 a decompressor for a cooling medium as a capillary, and at 4 a user-side heat exchanger, and those components are serially connected through a piping and constitute a refrigeration cycle. The reference numeral 5 is a heat exchanger for heat-exchanging between the decompressor 3 and a suction pipe for the compressor 1.

As a cooling medium in this refrigerator, for example, HFC134a is used, and as a refrigerating machine oil therein, for example, alkylbenzene-based oil having no or extremely low mutual solubility to HFC134a is used.

Next description is made for operations by using a pressure-enthalpy diagram. In the refrigerator having the configuration, vapor from a cooling medium (point A in the figure) under a high temperature and a high pressure compressed by the compressor 1 is condensed by the heat-source-side heat exchanger 2 to become a vapor-liquid two-phase cooling medium (point B in the figure) having dryness of around 0.1 as a quantity ratio of a liquid phase cooling medium in the vapor-liquid two-phase cooling medium, and is decompressed by the decompressor 3 for the cooling medium to flow into the user-side heat exchanger 4 as a vapor-liquid two-phase cooling medium under a low temperature and a low pressure (point C in the figure). Further, this cooling medium evaporates in the user-side heat exchanger 4, and returns to the compressor 1 through the heat exchanger 5 to be compressed again. The refrigerating machine oil discharged with the cooling medium from the compressor 1 circulates through a cooling medium circuit together with a vapor phase cooling medium as well as a liquid phase cooling medium, and returns to the compressor 1.

In this type of refrigerating/air-conditioning apparatus, alkylbenzene-based oil having no or extremely low mutual solubility to a cooling medium but being excellent in lubricity and abrasion resistance against a sliding section in the compressor 1 is used as refrigerating machine oil, so that it is possible to obtain a refrigerating/air-conditioning apparatus with high-reliability by securely returning the refrigerating machine oil to the compressor.

As described above, in the conventional type of refrigerating/air-conditioning apparatus, operational conditions and loading conditions are substantially constant, and when a flow rate of the cooling medium circulating a cooling medium circuit is sufficiently insured, refrigerating machine oil circulates with a cooling medium to flow back to the compressor without occurrence of excessive stagnation in a pipe and a capillary in the cooling medium circuit. Also, in the conventional type of refrigerating/air-conditioning apparatus, a state of a cooling medium at an outlet of the heat-source-side heat exchanger 2 is a vapor-liquid two-phase cooling medium, so that there is no pipe for a liquid with only liquid phase cooling medium flowing therethrough, and for this reason consideration on the stagnation of the refrigerating machine oil in the pipe for a liquid is not necessary.

As the conventional type of refrigerating/air-conditioning apparatus has the configuration as described above, if the operational conditions and loading conditions are largely changed, a flow rate of a cooling medium is reduced, or an oil rate in the refrigerating machine oil discharged from the compressor 1 increases, a life of the apparatus is largely reduced because an oil rate stagnating in the cooling medium increases, an oil rate flowing back to the compressor 1 decreases, and bad lubricity or the like occurs due to shortage of the refrigerating machine oil in the compressor 1.

Also, if a large amount of refrigerating machine oil is stagnated in a heat transfer pipe for the heat-source-side heat exchanger 2 as well as for the user-side heat exchanger 4, performance of heat transfer is reduced, pressure loss is increased, and energy efficiency of the refrigerating/air-conditioning apparatus is reduced or similar problems may occur.

Further, when refrigerating machine oil having no or extremely low mutual solubility to a cooling medium is used for a refrigerating/air-conditioning apparatus in which a pipe for a liquid such as an outlet section of the heat-source-side heat exchanger 2 with only a liquid phase cooling medium flowing therethrough exists over a long distance, an amount of the refrigerating machine oil stagnating in this pipe increases, an oil rate flowing back to the compressor 1 decreases, and bad lubricity or the like occurs due to shortage of the refrigerating machine oil in the compressor 1.

SUMMARY OF THE INVENTION

It is an object of the present invention to obtain a refrigerating/air-conditioning apparatus in which refrigerating machine oil discharged from a compressor is securely flown back to the compressor and in addition energy efficiency is sufficiently enhanced even if operational conditions and loading conditions are changed, or even if a pipe for a liquid with only a liquid phase cooling medium flowing therethrough exists in the apparatus.

A refrigerating/air-conditioning apparatus according to of the present invention has a refrigeration cycle using a cooling medium circuit in which a compressor, a heat-source-side heat exchanger, a decompressor, and a user-side heat exchanger are connected successively for circulating a cooling medium, and refrigerating machine oil having no or extremely low mutual solubility to the cooling medium; wherein a flow velocity of the cooling medium in a down comer, in which a liquid phase cooling medium flows from the upstream side to the down stream side in the refrigeration cycle, is higher than a flow velocity at which the refrigerating machine oil floating in the cooling medium flows downward.

In a refrigerating/air-conditioning apparatus according to the present invention, a flow velocity of the cooling medium flowing through the down comer is adjusted by changing an inner diameter of the down comer.

In a refrigerating/air-conditioning apparatus according to the present invention, a flow velocity of the cooling medium flowing through a down comer is adjusted by changing a rotational speed of a compressor.

In a refrigerating/air-conditioning apparatus according to the present invention, a flow velocity of hydrofluorocarbon, which is a liquid phase cooling medium containing alkylbenzene-based oil as refrigerating machine oil circulating through a refrigeration cycle, is 0.08 m/s or more.

In a refrigerating/air-conditioning apparatus according to the present invention, oil drops of refrigerating machine oil flowing and floating in the cooling medium in a down comer in which a liquid phase cooling medium flows from the upstream side to the down stream side in the refrigeration cycle are made fine.

In a refrigerating/air-conditioning apparatus according to the present invention, oil drops are made minute by refining elements provided in the upstream side of the down comer.

In a refrigerating/air-conditioning apparatus according to the present invention, oil drops are made minute by a plate with a hole provided thereon through which only an oil drop having a size less than a required one can pass.

In a refrigerating/air-conditioning apparatus according to the present invention, a content of refrigerating machine oil having extremely low mutual solubility to a cooling medium circulating through a refrigeration cycle is less than a solubility of a liquid phase cooling medium.

A refrigerating/air-conditioning apparatus according to the present invention returns refrigerating machine oil separated from a cooling medium by an oil separator provided at a midpoint of a discharge pipe for a compressor to the compressor.

A refrigerating/air-conditioning apparatus according to the present invention has an oil separator provided at a midpoint of a pipe connecting an outlet of a heat-source-side heat exchanger to an inlet of a decompressor and provides a refrigeration cycle for returning refrigerating machine oil separated from a cooling medium to a compressor.

A refrigerating/air-conditioning apparatus according to the present invention has a switch for inhibiting leakage of a cooling medium in an oil separator to a compressor side provided at a midpoint of an oil-returning pipe for returning refrigerating machine oil from the oil separator to the compressor.

In a refrigerating/air-conditioning apparatus according to the present invention, a temperature of a liquid phase cooling medium in an oil separator is made lower by making larger a supercooling degree in the cooling medium flowing out from a heat-source-side heat exchanger.

In a refrigerating/air-conditioning apparatus according to the present invention, a solubility of alkylbenzene-based oil as refrigerating machine oil circulating through a refrigeration cycle with hydrofluorocarbon as a liquid phase cooling medium is made to 0.8% or less.

In a refrigerating/air-conditioning apparatus according to the present invention, a temperature of a liquid phase cooling medium in an oil separator is lowered by cooling down the cooling medium by a heat exchanger provided inside the oil separator or in the upstream side from the oil separator.

A refrigerating/air-conditioning apparatus according to the present invention has an oil separator having a diameter of the main body thereof with which a flow velocity of a liquid phase cooling medium containing a cooling medium as hydrofluorocarbon and refrigerating machine oil as alkylbenzene-based oil each flowing through the oil separator is made to 0.08 m/s or less.

Other objects and features of this invention will become understood from the following description with reference to the accompanying drawings.

DESCRIPTION OF THE PREFERRED EMBODIMENT

Figure 1:
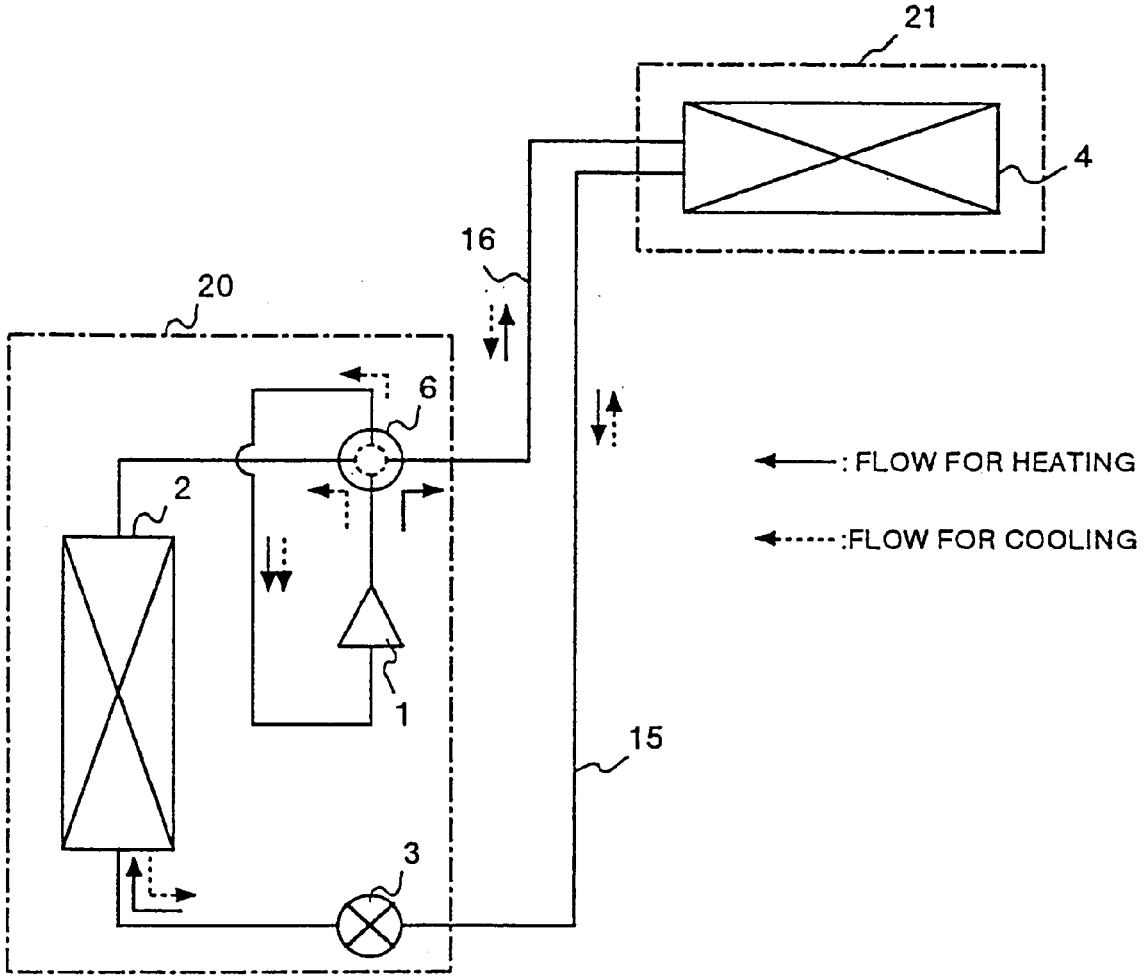
FIG. 1 is a circuit diagram for a cooling medium in the refrigerating/air-conditioning apparatus showing Embodiment 1 of the present invention.

FIG. 1 is a circuit diagram for a cooling medium showing one embodiment of the present invention, and the same reference numerals are assigned to the sections corresponding to those in the conventional type of apparatus. In the figure, the reference numeral 20 indicates an outdoor unit comprising a compressor 1, a four-way valve 6 for switching a flow for heating or cooling, a heat-source-side heat exchanger 2 operating as an evaporator in heating and as a condenser in cooling, and an electronic expansion valve as a decompressor 3. The reference numeral 21 indicates an indoor unit comprising a heat-source-side heat exchanger 4 operating as a condenser in heating and as an evaporator in cooling. The outdoor unit 20 and indoor unit 21 are connected to each other through two lines of pipe 15 and 16 constituting a refrigeration cycle. The indoor unit 21 is generally installed at a position higher than that of the outdoor unit 20.

A cooling medium (called as R410A hereinafter) obtained by mixing difluoromethane (called as HFC32) as hydrofluorocarbon with pentafluoroethane (called as HFC125) in the proportions of 50:50 is used in this refrigerating/air-conditioning apparatus, and as refrigerating machine oil, for example, alkylbenzene-based oil having extremely low mutual solubility to R410A and having smaller specific gravity than that of the liquid phase cooling medium is used.

Figure 2:
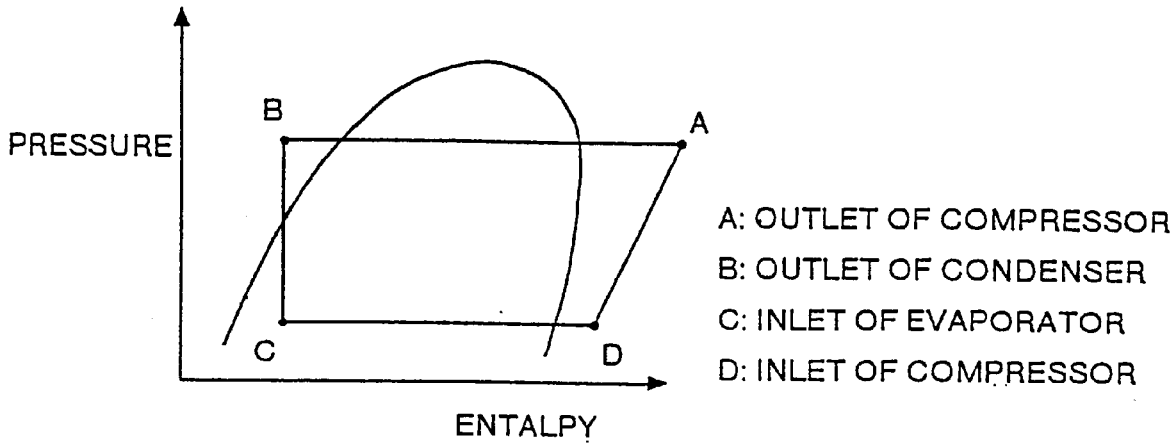
FIG. 2 is a pressure-enthalpy diagram showing operations of the refrigerating/air-conditioning apparatus in FIG. 1.

Next description is made for operations with reference to the pressure-enthalpy diagram shown in FIG. 2. For heating, at first, as indicated by an arrow in a solid line in FIG. 1, vapor from a cooling medium (corresponding to the point A in FIG. 2) under a high temperature and a high pressure compressed by the compressor 1 is condensed, through the pipe 16, by the user-side heat exchanger 4 operating as a condenser to be changed to a liquid phase (corresponding to the point B in FIG. 2). This liquid phase cooling medium passing through the pipe 15 is decompressed by the decompressor 3 for the cooling medium as an electronic expansion valve to become a vapor-liquid two-phase cooling medium under a low temperature and a low pressure and flows into the heat-source-side heat exchanger 2 operating as an evaporator (corresponding to the point C in FIG. 2). Further, this cooling medium evaporates in the heat-source-side heat exchanger 2, and returns to the compressor 1 through the four-way valve 6 to be compressed again.

On the other hand, when cooling, as indicated by an arrow in a broken line in FIG. 1, vapor from a cooling medium (corresponding to the point A in FIG. 2) with a high temperature and a high pressure compressed by the compressor 1 is condensed by the heat-source-side heat exchanger 2 operating as a condenser to be changed to a liquid phase (corresponding to the point B in FIG. 2). This liquid phase cooling medium is decompressed by the decompressor 3 for the cooling medium as an electronic expansion valve to become a vapor-liquid two-phase cooling medium under a low temperature and a low pressure, and flows, through the pipe 15, into the user-side heat exchanger 4 operating as an evaporator (corresponding to the point C in FIG. 2). Further, this cooling medium evaporates in the user-side heat exchanger 4, and returns to the compressor 1 through the pipe 16 and four-way valve 6 to be compressed again.

The alkylbenzene-based oil used as refrigerating machine oil in this refrigerating/air-conditioning apparatus has extremely low mutual solubility to the cooling medium R410A, and specific gravity of the alkylbenzene-based oil is also smaller than that of the liquid phase cooling medium R410A, so that the oil smoothly flows through the pipe where a liquid is going up in the same direction as that of the liquid phase cooling medium even the oil is separated from the liquid phase cooling medium, but, there is the possibility that the refrigerating machine oil separated from the liquid phase cooling medium may go up, when a flow velocity of the liquid phase cooling medium is small, due to its buoyancy and flow in the opposite direction to that of the cooling medium through the pipe where a liquid is going down.

For this reason, in this embodiment, the pipe 15 from the user-side heat exchanger 4 to the decompressor 3 for a cooling medium used for heating and a pipe between the heat-source-side heat exchanger 2 and the decompressor 3 for a cooling medium used for cooling are pipes for a liquid in which only a liquid phase cooling medium flows, and the down comer of those pipes in which a liquid phase cooling medium flows from the upstream side to a down stream side has an internal diameter with which a flow velocity of the cooling medium in the down comer is higher, when the liquid phase cooling medium is going down through inside the pipe, than a flow velocity at which the refrigerating machine oil floating as oil drops in the liquid phase cooling medium goes down.

Figure 3:
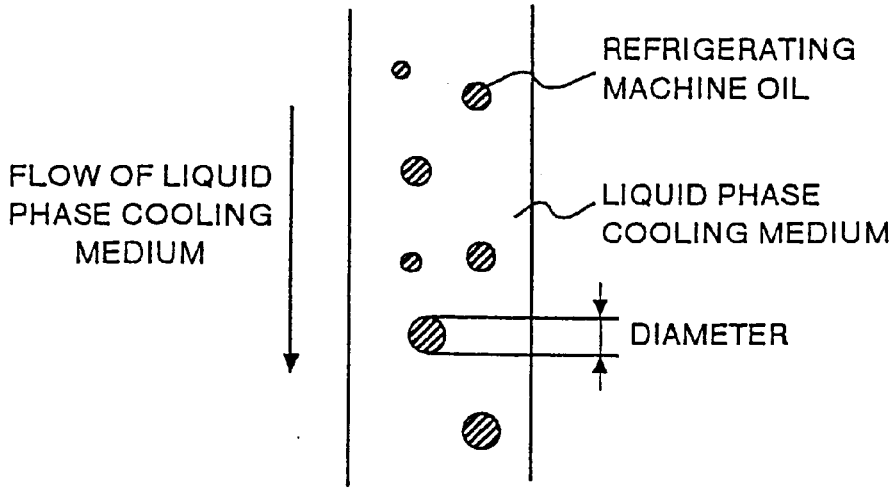
FIG. 3 is a concept view showing how refrigerating machine oil flows in a pipe for a liquid of the refrigerating/air-conditioning apparatus in FIG. 1.

FIG. 3 shows a result of an experimental study as to how the separated refrigerating machine oil is flowing through the pipe for a liquid going down. FIG. 3 visually shows the flowing state of the refrigerating machine oil in the pipe for a liquid going down, and it was found from the study that the most part of the refrigerating machine oil flows as oil drops through the liquid phase cooling medium although some part of the refrigerating machine oil becomes oil film to flow along the internal wall of the pipe. Also it was found that there are various sizes of diameter of the oil drops (indicated by d in the figure) and a descending velocity of a small oil drop is comparatively quick, but a descending velocity of a large oil drop is comparatively slow. Further it was found that, when the flow velocity of the descending liquid phase cooling medium is gradually reduced, there exist oil drops which stop in the liquid phase cooling medium or which ascend reversely to the flowing direction of the liquid phase cooling medium.

Figure 4:
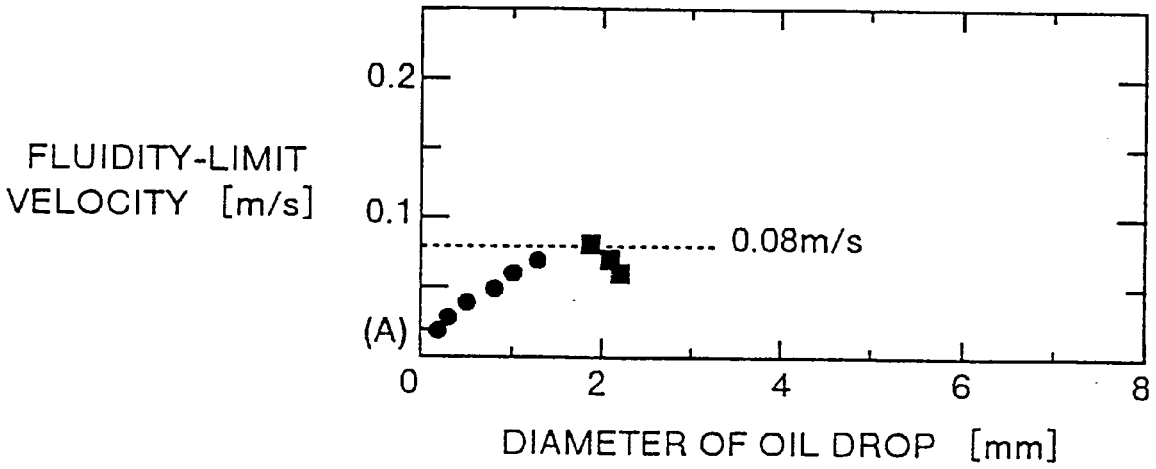
FIG. 4 is a relational view showing a relation between a diameter of an oil drop and a fluidity-limit velocity.

FIG. 4 shows, as a result of recording a flow of a liquid through the down comer by a high-speed video camera and reading a diameter of an oil drop at rest from the video when a flow velocity of the descending liquid phase cooling medium is changed, a correlation between each flow velocity of the liquid phase cooling medium and each diameter of the oil drops at rest at that time. The X-axis in FIG. 4 indicates a diameter of an oil drop, ad the Y-axis indicates an average flow velocity (a cooling medium volume flow rate/a pipe cross-sectional area) of a liquid phase cooling medium when the oil drop is stopped. Namely, the flow velocity of a cooling medium in the Y-axis shows each flow velocity of a cooling medium when oil drops each having a different diameter have come to a standstill, and also shows a flow velocity at which any oil drop having a flow velocity more than the flow velocity of a cooling medium can descend and flow together with a liquid phase cooling medium (called as a fluidity-limit velocity hereinafter).

As clearly understood from FIG. 4, an oil drop with a small diameter has a fluidity-limit velocity which is comparatively small because its buoyancy is also small, so that the oil drop smoothly descends together with a liquid phase cooling medium even if the flow velocity of the liquid phase cooling medium is small, but when a diameter of an oil drop is larger, the buoyancy of the oil drop is larger, which makes the fluidity-limit velocity larger. It is conceivable that the fluidity-limit velocity starts to decrease, when a diameter of an oil drop is around 2 mm or more (black circles in the figure), that is because the oil drop transfers from a spherical shape to a compressed shape so that fluid power received from the descending liquid phase cooling medium increases. It is found from this result (black squares in the figure) that the fluidity-limit velocity of an oil drop generated in the pipe for a liquid changes according to a diameter of the oil drop, but that, if a flow velocity of a liquid phase cooling medium of 0.08 m/s or more is insured, any oil drop having any diameter generated can flow smoothly.

Accordingly, in this embodiment, a pipe for a descending liquid such as the pipe 15 from the user-side heat exchanger 4 to the decompressor 3 for a cooling medium used for heating and a pipe between the heat-source-side heat exchanger 2 and the decompressor 3 for a cooling medium used for cooling is designed to have a diameter with which a flow velocity of a liquid phase cooling medium is adjusted to 0.08 m/s or more, so that refrigerating machine oil floating as oil drops in the liquid phase cooling medium descends smoothly together with the liquid phase cooling medium, and the oil can flow back to the compressor 1 without occurrence of stagnation in the pipe for a liquid, which eliminates shortage of oil quantity in the compressor 1, and for this reason a refrigerating/air-conditioning apparatus with high reliability can be obtained.

Figure 5:
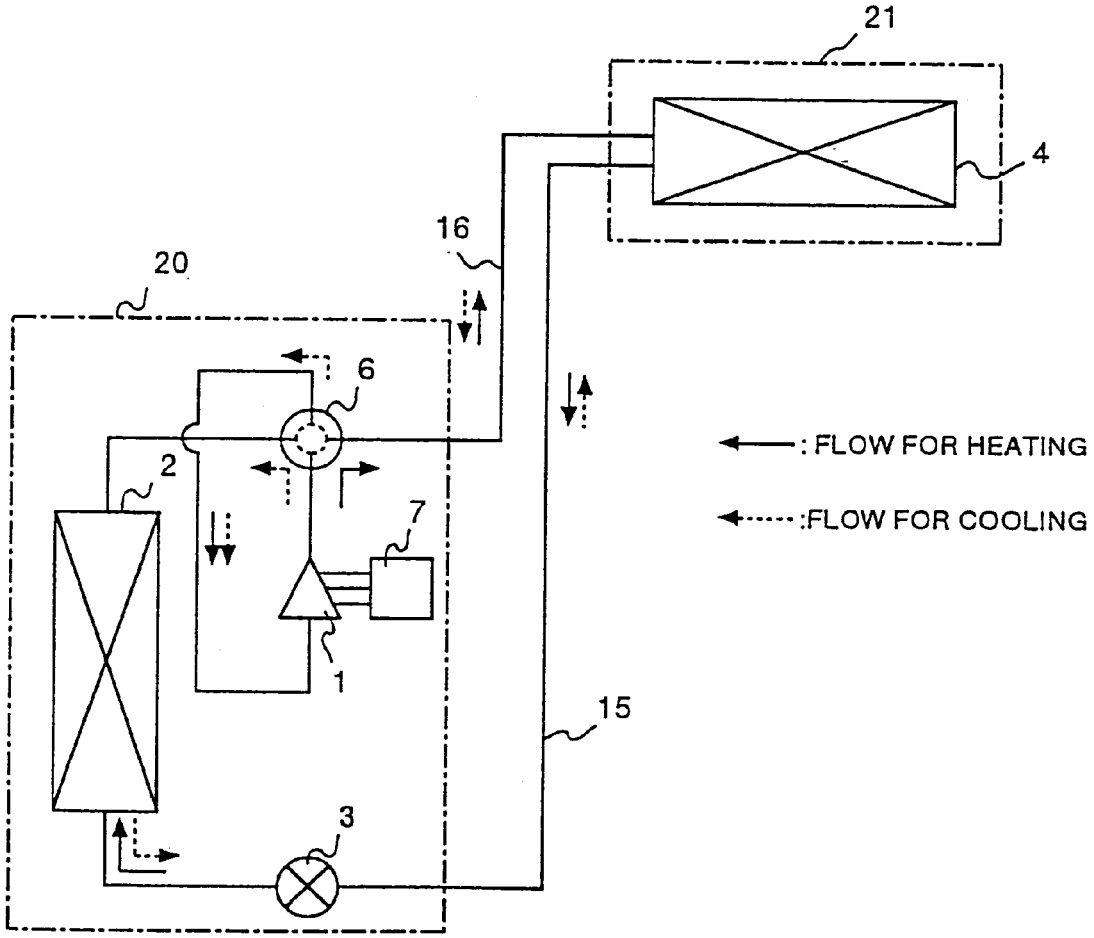
FIG. 5 is a circuit diagram for a cooling medium in the refrigerating/air-conditioning apparatus showing Embodiment 2 of the present invention.

FIG. 5 is a circuit diagram for a cooling medium in a refrigerating/air-conditioning apparatus showing another embodiment of the present invention, in which the compressor 1 is constructed so that a rotational speed is variable by an inverter 7 and the capability matching to a load can be delivered by controlling the rotational speed of the compressor 1 and increasing or decreasing a flow rate of a cooling medium according to the load conditions. It should be noted that the same reference numerals are assigned to the sections corresponding to those in FIG. 1, and description thereof is omitted herein.

When the load is decreased, the rotational speed of the compressor 1 is reduced by the inverter 7, a flow rate of the cooling medium circulating through the cooling medium circuit is made less, so that heating capability or cooling capability is made smaller. In this embodiment, a minimum value of the rotational speed of this compressor 1 is set to a rotational speed so that a flow velocity of a cooling medium in a pipe for a descending liquid such as the pipe 15 from the user-side heat exchanger 4 to the decompressor 3 for a cooling medium used for heating and a pipe between the heat-source-side heat exchanger 2 and the decompressor 3 for a cooling medium used for cooling becomes a value more than a fluidity-limit velocity at which refrigerating machine oil floating in a liquid phase cooling medium smoothly flows, namely a flow velocity of the liquid phase cooling medium is 0.08 m/s or more.

Accordingly, even if the rotational speed of the compressor 1 is reduced and a flow rate of the cooling medium is smaller, the flow velocity of the cooling medium in the pipe for a descending liquid insures a value more than the fluidity-limit velocity at which refrigerating machine oil floating in a liquid phase cooling medium smoothly flows, so that the refrigerating machine oil can flow back to the compressor 1 without occurrence of stagnation in the pipe for a liquid, which eliminates shortage of oil quantity in the compressor 1, and for this reason a refrigerating/air-conditioning apparatus with high reliability can be obtained.

Figure 6:
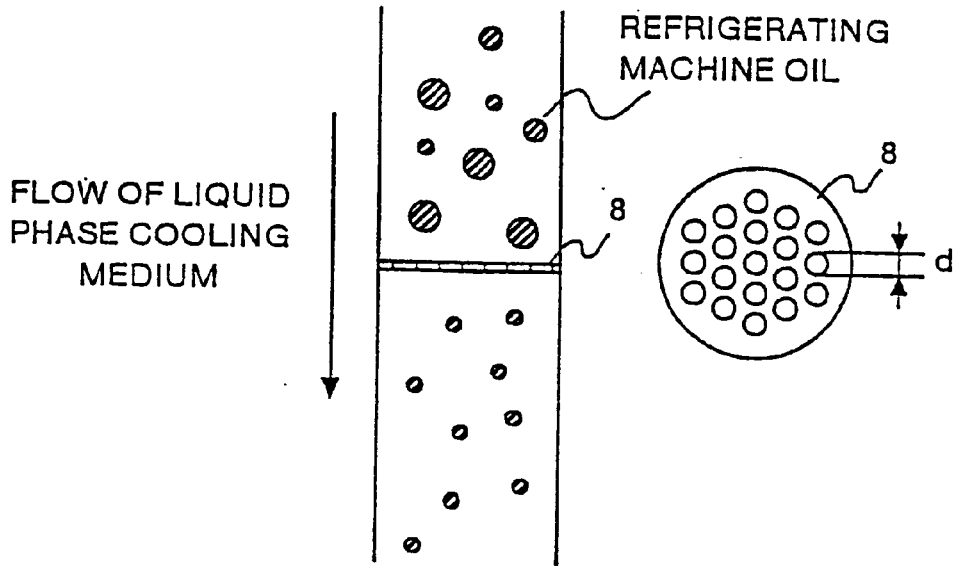
FIG. 6 is a cross-sectional view of a pipe for a liquid showing Embodiment 3 of the present invention.

FIG. 6 is a cross-sectional view of a pipe for a descending liquid showing another embodiment of the present invention, in which the reference numeral 8 indicates a refining element for oil drops provided inside this pipe for a liquid. This refining element 8 for oil drops comprises a disk with a plurality units of small holes provided thereon each having a diameter (indicated by d in the figure). Although there exist oil drops each having a different diameter in the pipe for a liquid in the upstream side of this refining element 8 for oil drops, those oil drops are refined when passing through the refining element 8 for oil drops, so that only the oil drops each having a diameter less than that of the hole indicated by d on the refining element pass through the holes, and other oil drops each having a diameter larger than that of the hole on the refining element are separated into small oil drops and flow.

As described above, by providing refining element 8 for oil drops inside a pipe for a descending liquid, each diameter of oil drops flowing through the pipe for a liquid is made smaller, and refrigerating machine oil easily flows together with a liquid phase cooling medium in the same direction, so that the refrigerating machine oil can flow back to the compressor 1 without occurrence of stagnation in the pipe for a liquid, which eliminates shortage of oil quantity in the compressor 1, and for this reason a refrigerating/air-conditioning apparatus with high reliability can be obtained.

It should be noted that the description has assumed a case where the refining element 8 for oil drops comprises a disk with a plurality units of small holes provided thereon each having a diameter d in the above embodiment, but the element is not limited to the above example, and may comprise a disk type of mesh or a sintered metal.

Also, by spacing a plurality units of this refining element 8 for oil drops in a pipe for a descending liquid, further more effect of the element can be delivered.

Description is made hereinafter for another embodiment of the present invention with reference to the circuit diagram for a cooling medium in the refrigerating/air-conditioning apparatus shown in FIG. 1. In this embodiment, an oil rate discharged from the compressor 1 to a cooling medium circuit is adjusted so that the rate is less than the solubility of refrigerating machine oil with a liquid phase cooling medium, and for this reason, the compressor 1 which can always insure appropriate lubricity without separating refrigerating machine oil from the cooling medium is used.

Figure 7:
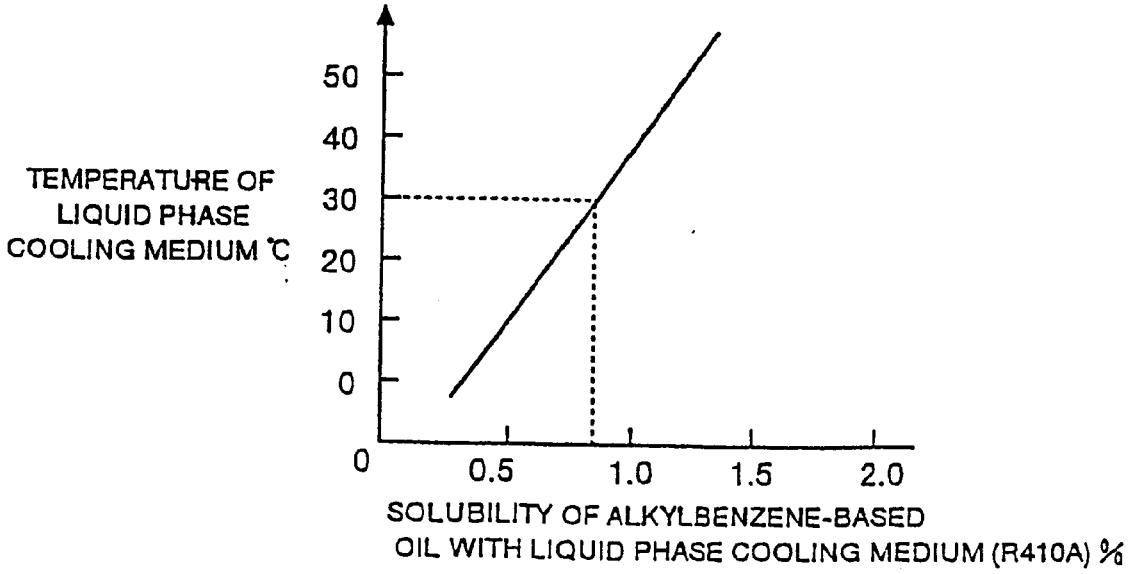
FIG. 7 is a relational diagram showing solubility of alkylbenzene-based oil with a liquid phase cooling medium.

FIG. 7 shows a result of measurement of solubility at a quantity ratio (=mass of alkylbenzene-based oil/(mass of alkylbenzene-based oil+mass of a cooling medium) ) at which oil is separated and emulsified when alkylbenzene-based oil is added to a liquid phase cooling medium of R410A. The Y-axis of the figure indicates a temperature of a liquid phase cooling medium, and the X-axis indicates solubility of alkylbenzene-based oil with R410A. It is clearly understood from this figure that the alkylbenzene-based oil slightly dissolves in the liquid phase cooling medium of R410A, and the solubility thereof becomes smaller as a temperature of the liquid phase cooling medium drops. When the oil rate discharged from the compressor into the cooling medium circuit is less than this solubility, all the alkylbenzene-based oil dissolves in the liquid phase cooling medium in the pipe for a liquid. For this reason, the refrigerating machine oil does not stagnate in the pipe for a liquid and shortage of oil quantity does not also occur in the compressor 1.

The lowest value of the temperature of a liquid phase cooling medium in the pipe for a liquid is around 30° C. in a room air conditioner, and it is understood from FIG. 7 that the alkylbenzene-based oil dissolves in the liquid phase cooling medium of R410A by 0.8% or more under the above condition. Accordingly, by adjusting an oil circulation ratio discharged from the compressor 1 into the cooling medium circuit (=a flow rate of mass of oil/(a flow rate of mass of oil+a flow rate of mass of a cooling medium) ) to be 0.8% or less, all the alkylbenzene-based oil dissolves in the liquid phase cooling medium in the pipe for a liquid, and the refrigerating machine oil does not stagnate in the pipe for a liquid, and for this reason shortage of oil quantity does not also occur in the compressor 1.

Figure 8:
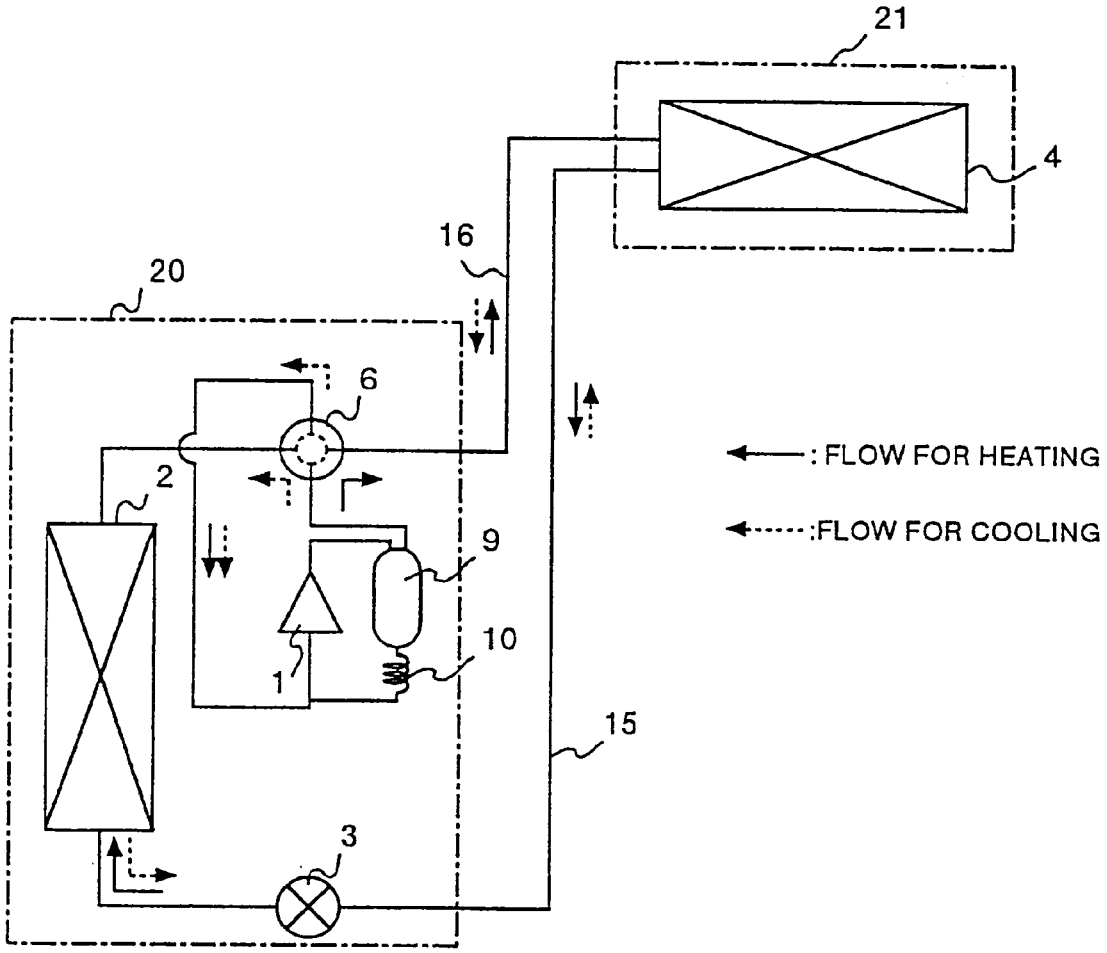
FIG. 8 is a circuit diagram for a cooling medium in the refrigerating/air-conditioning apparatus showing Embodiment 5 of the present invention.

FIG. 8 is a circuit diagram for a cooling medium in a refrigerating/air-conditioning apparatus showing another embodiment of the present invention, in which an oil separator 9 is provided at a midpoint of a discharge pipe for the compressor 1, and the lower section of this oil separator 9 is connected to a suction pipe of a compressor 1 through a decompressor 10 for refrigerating machine oil as a capillary, so that the refrigerating machine oil separated by the oil separator 9 is returned to the compressor 1. In this embodiment, even if an oil rate discharged from the compressor 1 is more than solubility of the refrigerating machine oil with a liquid phase cooling medium, namely 0.8% or more, an oil rate to flow out to a cooling medium circuit is constructed so as to be 0.8% or less according to an effect the oil separator.

Accordingly, an oil rate to flow out to the cooling medium circuit is always less than the solubility of the refrigerating machine oil with the liquid phase cooling medium, so that all the refrigerating machine oil dissolves in the liquid phase cooling medium, and the refrigerating machine oil does not stagnate in the pipe for a liquid, and for this reason shortage of oil quantity does not also occur in the compressor 1.

Also, as a method of improving efficiency of oil separation in the oil separator 9, by making larger a diameter of the main body of the oil separator 9 and making smaller a flow velocity of a vapor phase cooling medium in the oil separator 9, the efficiency of oil separation in the oil separator 9 can be improved.

Figure 9:
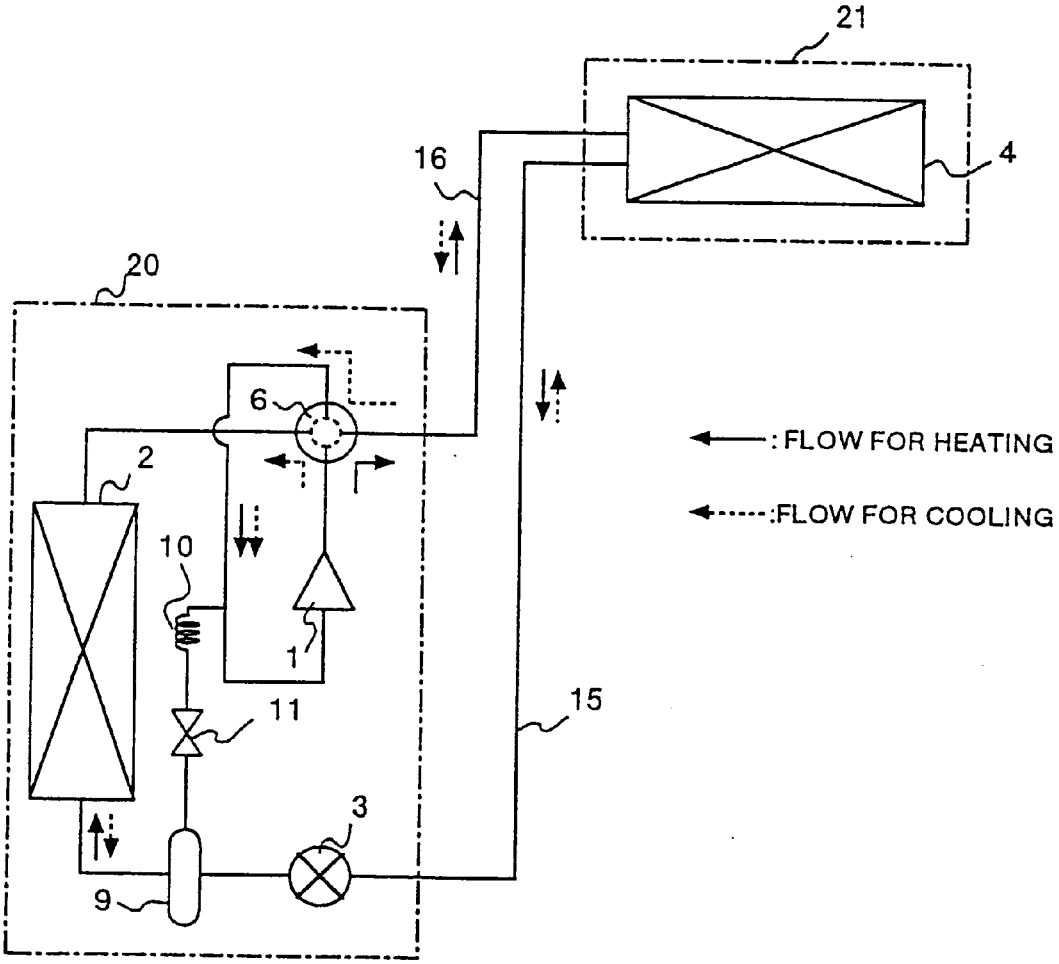
FIG. 9 is a circuit diagram for a cooling medium in the refrigerating/air-conditioning apparatus showing Embodiment 6 of the present invention.

FIG. 9 is a circuit diagram for a cooling medium in a refrigerating/air-conditioning apparatus showing another embodiment of the present invention, in which an oil separator 9 is provided in a pipe between a heat-source-side heat exchanger 2 and a decompressor 3 for a cooling medium as an electric expansion valve. The upper section of the oil separator 9 is connected to a suction pipe for a compressor 1 through a switch 11 as an electromagnetic valve and a decompressor 10 for refrigerating machine oil as a capillary, so that the refrigerating machine oil deposited in the upper section of the oil separator 9 is returned to the compressor Next description is made for operations. For cooling, at first, vapor from a cooling medium under a high temperature and a high pressure compressed by the compressor 1 is condensed by a heat-source-side heat exchanger 2 operating as a condenser to be changed to a liquid phase and flows into the oil separator 9. When an oil rate flowing from the compressor 1 into the cooling medium circuit is more than solubility of alkylbenzene-based oil with the liquid phase cooling medium shown in FIG. 7, refrigerating machine oil is separated from the liquid phase cooling medium in the oil separator 9, and the refrigerating machine oil as alkylbenzene-based oil having a specific gravity smaller than that of the liquid phase cooling medium stagnates in the upper section of the oil separator 9. As the switch 11 is switched to be open during cooling, the refrigerating machine oil stagnated in the upper section of the oil separator 9 returns to the compressor 1 through the switch 11 and the decompressor 10 for the refrigerating machine oil. Also, an oil rate contained in the liquid phase cooling medium which flowed out from the oil separator 9 can be reduced, so that it is possible to prevent reduction of heat transfer performance generated caused by the oil flowing into the user-side heat exchanger 4 operating as an evaporator and stagnated in a heat-transfer pipe 15.

Also, the solubility of alkylbenzene-based oil with the liquid phase cooling medium is reduced as decrease of the temperature of the liquid phase cooling medium as shown in FIG. 7, so that a rate of oil to be separated in the oil separator 9 can be increased by making lower the temperature of the liquid phase cooling medium in the oil separator 9. In other words, by reducing aperture of the decompressor or increasing a filling rate of cooling medium, a degree of supercooling is increased, which makes larger a degree of supercooling indicated by a difference between a temperature of the outlet of the heat-source-side heat exchanger 2 for a cooling medium and a temperature of condensation, so that a temperature of the liquid phase cooling medium in the oil separator 9 is decreased, and for this reason, efficiency of oil separation in the oil separator 9 can be improved.

On the other hand, for heating, vapor from a cooling medium under a high temperature and a high pressure compressed by the compressor 1 is condensed, through the pipe 16, by the user-side heat exchanger 4 operating as a condenser to be changed to a liquid phase. This liquid phase cooling medium passes through the pipe 15 as a down comer, is decompressed by the decompressor 3 for the cooling medium as an electronic expansion valve to become a vapor-liquid two-phase cooling medium under a low temperature and a low pressure and flows into the oil separator 9. The vapor-liquid two-phase cooling medium flows into the oil separator 9 during heating, the refrigerating machine oil can not be separated from the cooling medium, so that the switch 11 is switched to be closed, and reduction of energy efficiency due to flow of the cooling medium from the oil separator to the compressor 1 and damage to the compressor 1 due to liquid compression are prevented.

Accordingly, in this embodiment, refrigerating machine oil is separated from a liquid phase cooling medium at the outlet of the heat-source-side heat exchanger 2 as a condenser and returned to the compressor 1 during cooling, so that it is possible to obtain a refrigerating/air-conditioning apparatus with high-energy efficiency without stagnation of oil in an evaporator. Also, during heating, flow of the cooling medium from the oil separator 9 to the compressor 1 is prevented, so that it is possible to obtain refrigerating/air-conditioning apparatus in which reduction of energy efficiency can be prevented and the compressor 1 is not damaged by liquid compression.

Figure 10:
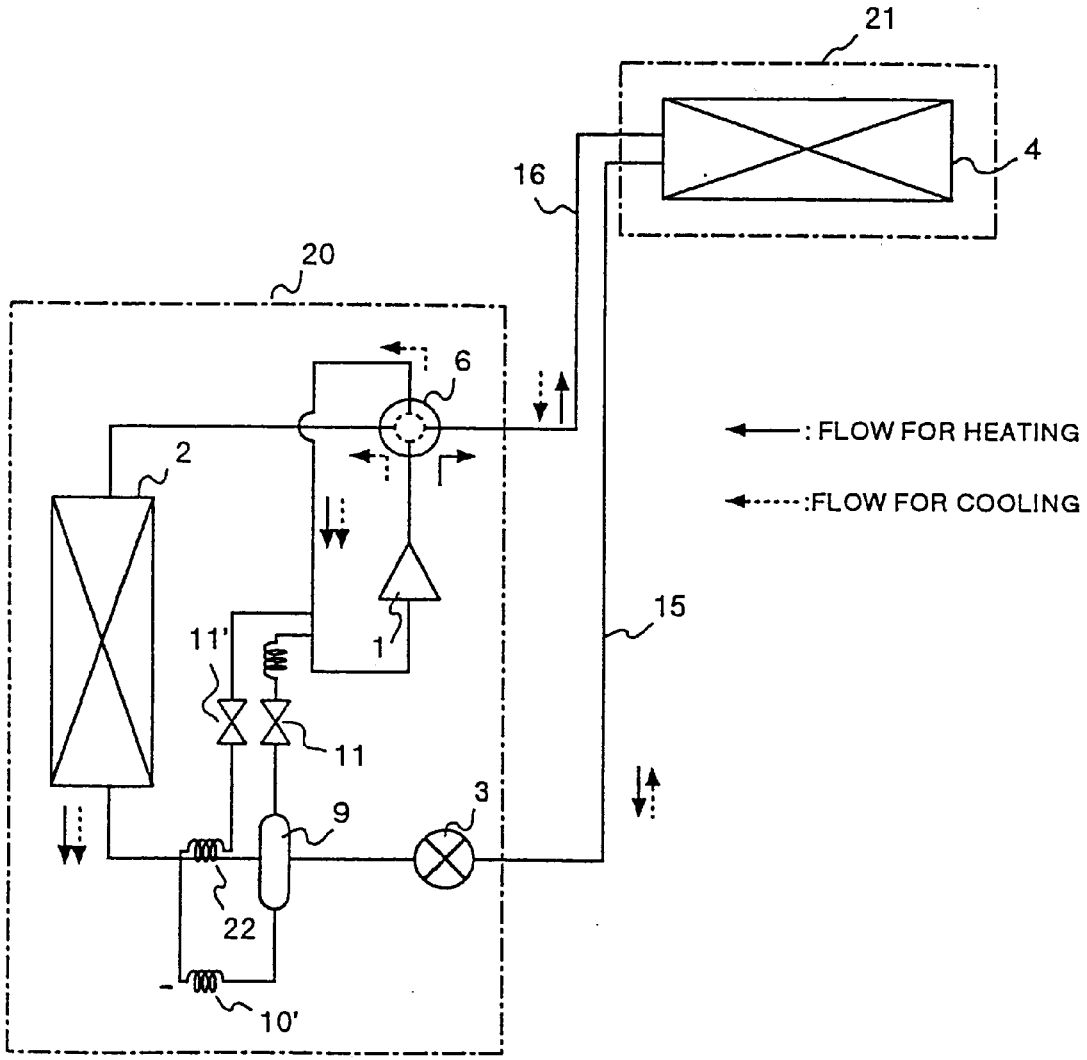
FIG. 10 is a circuit diagram for a cooling medium in the refrigerating/air-conditioning apparatus showing Embodiment 7 of the present invention.
Figure 11:
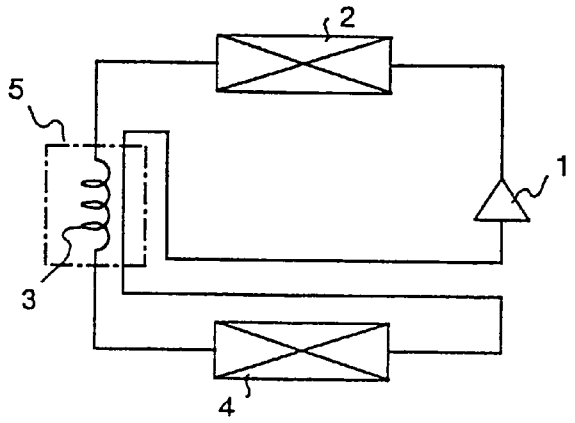
FIG. 11 is a circuit diagram for a cooling medium in the refrigerating/air-conditioning apparatus based on the conventional technology.
Figure 12:
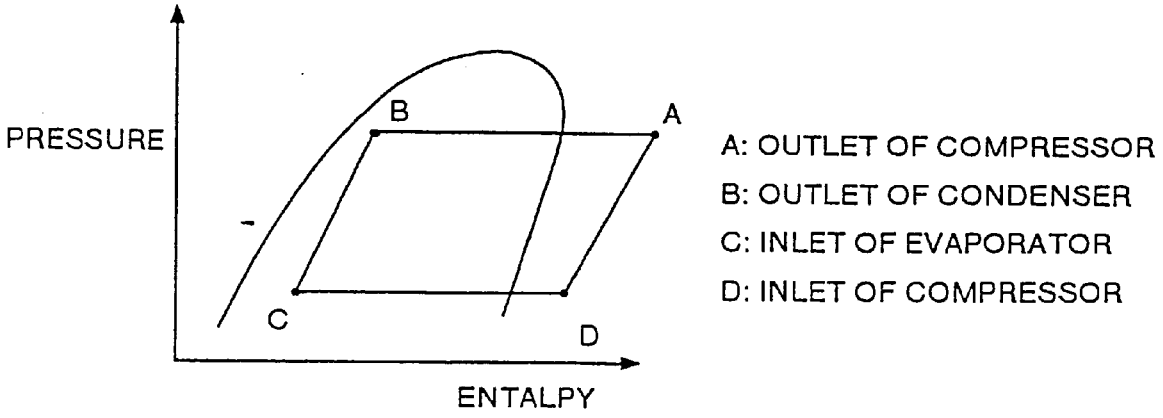
FIG. 12 is a pressure-enthalpy diagram showing operations of the refrigerating/air-conditioning apparatus in FIG. 11.

FIG. 10 is a circuit diagram for a cooling medium in a refrigerating/air-conditioning apparatus showing another embodiment, in which an oil separator 9 is provided between a heat-source-side heat exchanger 2 and a decompressor 3 for a cooling medium as an electric expansion valve, and further, the upper section of the oil separator 9 is connected to a suction pipe for a compressor 1 through a switch 11 as an electromagnetic valve and a decompressor 10 for refrigerating machine oil as a capillary, so that the refrigerating machine oil deposited in the upper section of the oil separator 9 is returned to the compressor 1. In contrast to Embodiment 6, this embodiment is characterized in that a heat exchanger 22 for decreasing a temperature of a liquid phase cooling medium flowing into an oil separator during cooling is provided in a pipe between the heat-source-side heat exchanger 2 and the oil separator 9.

Next description is made for operations. For cooling, at first, vapor from a cooling medium containing refrigerating machine oil under a high temperature and a high pressure compressed by the compressor 1 is condensed by the heat-source-side heat exchanger 2 operating as a condenser to be changed to a liquid phase cooling medium and flows into the oil separator 9. When an oil rate flowing from the compressor 1 into the cooling medium circuit is more than solubility of alkylbenzene-based oil with the liquid phase cooling medium shown in FIG. 7, refrigerating machine oil is separated from the liquid phase cooling medium in the oil separator 9, and the refrigerating machine oil as alkylbenzene-based oil having a specific gravity smaller than that of the liquid phase cooling medium stagnates in the upper section of the oil separator 9. As the switch 11 is switched to be open during cooling, the refrigerating machine oil stagnated in the upper section of the oil separator 9 returns to the compressor 1 through the switch 11 and the decompressor 10 for the refrigerating machine oil.

Further, as a switch 11' is switched to be open, one portion of the liquid phase cooling medium in the lower section of the oil separator 9 evaporates through a decompressor 10' as a capillary, and the cooling medium under a low temperature returns to the compressor 1 through the heat exchanger 22. During the operation, the temperature of the liquid phase cooling medium liquid-phased by being condensed by the heat-source-side heat exchanger 2 and be changed to a liquid phase is decreased by the heat exchanger 22, the cooling medium under the decreased temperature flows into the oil separator 9, separation of refrigerating machine oil from the cooling medium is promoted, and a content of the refrigerating machine oil in the cooling medium flowing out from the oil separator 9 is reduced, and with this feature, a rate of refrigerating machine oil separated from the cooling medium can largely be reduced from the above processes till the cooling medium is reaching a user-side heat exchanger 4 operating as an evaporator. Further, by adjusting a temperature of refrigerating machine oil so as not to be lower than the temperature of the liquid phase cooling medium in the oil separator 9, it is also possible to eliminate separation of the refrigerating machine oil contained in the liquid phase cooling medium flowing out from the oil separator 9 during the process from the oil separator 9 to the user-side heat exchanger 4.

A unit applying a duplex pipe or the like may be placed for the heat exchanger 22 provided in a pipe between the heat-source-side heat exchanger 2 and the oil separator 9, but the same effect can be obtained by providing a pipe through which a cooling medium in a low temperature passes along the external section of the heat exchanger itself, or by inserting the pipe in a coil form inside the exchanger.

On the other hand, for heating, vapor from a cooling medium under a high temperature and a high pressure compressed by the compressor 1 is condensed, through the pipe 16, by the user-side heat exchanger 4 operating as a condenser to be changed to a liquid phase. This liquid phase cooling medium passes through the pipe 15 as a down comer, is decompressed by the decompressor 3 for the cooling medium as an electronic expansion valve to become a vapor-liquid two-phase cooling medium under a low temperature and a low pressure and flows into the oil separator 9. The vapor-liquid two-phase cooling medium flows into the oil separator 9 during heating, the refrigerating machine oil can not be separated from the cooling medium, so that the switches 11 and 11' are switched to be closed, and reduction of energy efficiency due to flow of the cooling medium from the oil separator to the compressor 1 and damage to the compressor 1 due to liquid compression are prevented.

Accordingly, in this embodiment, refrigerating machine oil is separated from a liquid phase cooling medium at the outlet of the heat-source-side heat exchanger 2 as a condenser and returned to the compressor 1 during cooling, and also a rate of refrigerating machine oil flowing into the user-side heat exchanger 4 operating as an evaporator can largely be reduced as compared to Embodiment 6, so that it is possible to obtain a refrigerating/air-conditioning apparatus with high-energy efficiency which can prevent reduction of heat transfer performance caused by stagnation in the heat-transfer pipe 15. Also, during heating, similar to Embodiment 6, flow of the cooling medium from the oil separator 9 to the compressor 1 is prevented, so that it is possible to obtain refrigerating/air-conditioning apparatus in which reduction of energy efficiency can be prevented and the compressor 1 is not damaged by liquid compression.

It should be noted that, although the description has been made in the embodiment for the case where the invention is applied in an air conditioner such as a room air conditioner with which a room temperature can freely be adjusted, the application is not limited to the above case, and the invention is applicable to a cold reserving vehicle, a prefabricated freezer/refrigerator, and a refrigerator for home use, and in this case the same effect can also be achieved.

As described above, the refrigerating/air-conditioning apparatus according to the present invention has a refrigeration cycle using a cooling medium circuit in which a compressor, a heat-source-side heat exchanger, a decompressor, and a user-side heat exchanger are connected successively for circulating a cooling medium, and refrigerating machine oil having no or extremely low mutual solubility to the cooling medium; and a flow velocity of the cooling medium in a down comer, in which a liquid phase cooling medium flows from the upstream side to the down stream side in the refrigeration cycle, is higher than a flow velocity at which the refrigerating machine oil floating in the cooling medium descends, so that stagnation of refrigerating machine oil in a pipe for a liquid does not occur and return of the oil to a compressor is improved.

In the refrigerating/air-conditioning apparatus according to the present invention, a flow velocity of the cooling medium is adjusted by changing an internal diameter of the down comer, so that a flow velocity of a cooling medium in a down comer in which a liquid phase cooling medium flows can be made higher than a flow velocity at which the refrigerating machine oil floating in the cooling medium descends without mounting thereon or changing of complicated equipment.

In the refrigerating/air-conditioning apparatus according to the present invention, a flow velocity of the cooling medium is adjusted by changing a rotational speed of a compressor, so that a flow velocity of a cooling medium in a down comer in which a liquid phase cooling medium flows can be made higher than a flow velocity at which the refrigerating machine oil floating in the cooling medium descends without changing of basic designing of a cooling medium circuit.

In the refrigerating/air-conditioning apparatus according to the present invention, a flow velocity of hydrofluorocarbon, which is a liquid phase cooling medium containing alkylbenzene-based oil as refrigerating machine oil circulating through a refrigeration cycle, is 0.08 m/s or more, so that refrigerating machine oil floating as oil drops in a pipe for a liquid surely flows together with a liquid phase cooling medium also in a down comer, and for this reason stagnation of the refrigerating machine oil does not occur in a pipe for a liquid.

In the refrigerating/air-conditioning apparatus according to the present invention, oil drops of refrigerating machine oil flowing and floating in the cooling medium in a down comer in which a liquid phase cooling medium flows from the upstream side to the down stream side in the refrigeration cycle are made fine, so that, even if a flow velocity of a liquid phase cooling medium is slow, oil drops flow together with a liquid phase cooling medium also in a down comer, and for this reason stagnation of the refrigerating machine oil does not occur in a pipe for a liquid.

In the refrigerating/air-conditioning apparatus according to the present invention, oil drops are made minute by refining elements provided in the upstream side of the down comer, so that the oil drops can flow at a flow velocity in the down comer, and for this reason stagnation of refrigerating machine oil does not occur in a down comer.

In the refrigerating/air-conditioning apparatus according to the present invention, oil drops are made minute by a plate with a hole provided thereon through which only an oil drop having a size less than a required one can pass, so that oil drops hardly causes fluid resistance against a liquid phase cooling medium, and for this reason stagnation of refrigerating machine oil can be eliminated by reducing pressure loss.

In the refrigerating/air-conditioning apparatus according to the present invention, a content of refrigerating machine oil having extremely low mutual solubility to a cooling medium circulating through a refrigeration cycle is less than a solubility of a liquid phase cooling medium, so that there is no possibility that refrigerating machine oil becomes oil drops in a pipe for a liquid, and for this reason, the refrigerating machine oil is not stagnated caused by separation thereof from a cooling medium in the pipe.

The refrigerating/air-conditioning apparatus according to the present invention returns refrigerating machine oil separated from a cooling medium by an oil separator provided at a midpoint of a discharge pipe for a compressor to the compressor, so that shortage of oil in a compressor can be prevented, and for this reason lubricity and abrasion resistance against a sliding section in the compressor is not reduced.

The refrigerating/air-conditioning apparatus according to the present invention has an oil separator provided at a midpoint of a pipe connecting an outlet of a heat-source-side heat exchanger to an inlet of a decompressor and provides a refrigeration cycle for returning refrigerating machine oil separated from a cooling medium to a compressor, so that refrigerating machine oil can be prevented from flowing in a user-side heat exchanger during cooling, and for this reason efficiency of a heat exchanger is not reduced, and in addition, returning of oil to a compressor is improved, which allows abrasion of a driving section to be prevented.

The refrigerating/air-conditioning apparatus according to the present invention has a switch for inhibiting leakage of a cooling medium in an oil separator to a compressor side provided at a midpoint of an oil-returning pipe for returning refrigerating machine oil from the oil separator to the compressor, so that a cooling medium can be prevented from flowing into a compressor by a short, and for this reason energy efficiency is not impaired.

In the refrigerating/air-conditioning apparatus according to the present invention, a temperature of a liquid phase cooling medium in an oil separator is made lower by making larger a supercooling degree in the cooling medium flowing out from a heat-source-side heat exchanger, so that separation capability of refrigerating machine oil is improved and it is difficult to generate oil drops by separating the refrigerating machine oil in a refrigeration cycle.

In the refrigerating/air-conditioning apparatus according to the present invention, a solubility of alkylbenzene-based oil as refrigerating machine oil circulating through a refrigeration cycle with hydrofluorocarbon as a liquid phase cooling medium is made to 0.8% or less, so that there is no possibility of generating oil drops due to separation of refrigerating machine oil from a cooling medium in a refrigeration cycle, and for this reason loss of energy efficiency caused by stagnation of the refrigerating machine oil in the pipe is not effected.

In the refrigerating/air-conditioning apparatus according to the present invention, a temperature of a liquid phase cooling medium in an oil separator is lowered by cooling down the cooling medium by a heat exchanger provided inside the oil separator or in the upstream side from the oil separator, so that, during cooling, refrigerating machine oil is separated from a liquid phase cooling medium at an outlet of a heat-source-side heat exchanger as a condenser and is returned to a compressor, and a rate of the refrigerating machine oil flowing into a user-side heat exchanger operating as an evaporator can largely be reduced, so that it is possible to obtain a refrigerating/air-conditioning apparatus with high-energy efficiency which can prevent reduction of heat transfer performance generated caused by the oil stagnated in a heat transfer pipe.

The refrigerating/air-conditioning apparatus according to the present invention has an oil separator having a diameter of the main body thereof with which a flow velocity of a liquid phase cooling medium containing a cooling medium as hydrofluorocarbon and refrigerating machine oil as alkylbenzene-based oil flowing through the oil separator is made to 0.08 m/s or less, so that there is no possibility of generating oil drops due to separation of refrigerating machine oil from a cooling medium in a refrigeration cycle, and for this reason loss of energy efficiency caused by stagnation of the refrigerating machine oil in the pipe is not effected.

This application is based on Japanese patent applications No. HEI 9-222139 and HEI 9-357314 filed in the Japanese Patent Office on Aug. 19, 1997 and Dec. 25, 1997, respectively, the entire contents of which are hereby incorporated by reference.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A refrigerating/air-conditioning apparatus based on a refrigeration cycle using a cooling medium circuit in which a compressor, a heat-source-side heat exchanger, a decompressor, and a user-side heat exchanger are connected successively for circulating a cooling medium, wherein the refrigerating/air-conditioning apparatus is configured so that a flow velocity of the cooling medium in a down comer, in which a liquid phase cooling medium as a cooling medium in a liquid phase flows from the upstream side to the down stream side in said refrigeration cycle, is higher than a flow velocity at which refrigerating machine oil floating in the cooling medium goes down.

2. A refrigerating/air-conditioning apparatus according to claim 1; wherein a flow velocity of the cooling medium is adjusted by changing an inner diameter of said down comer.

3. A refrigerating/air-conditioning apparatus according to claim 1; wherein a flow velocity of the cooling medium is adjusted by changing a rotational speed of said compressor.

4. A refrigerating/air-conditioning apparatus according to claim 1; wherein a flow velocity of hydrofluorocarbon, which is a liquid phase cooling medium containing alkylbenzene-based oil as refrigerating machine oil, is 0.08 m/s or more.

5. A refrigerating/air-conditioning apparatus based on a refrigeration cycle using a cooling medium circuit in which a compressor, a heat-source-side heat exchanger, a decompressor, and a user-side heat exchanger are connected successively for circulating a cooling medium, wherein the refrigerating/air conditioning apparatus is configured so that oil drops of refrigerating machine oil flowing and floating in the cooling medium in a down comer in which a liquid phase cooling medium flows from the upstream side to the down stream side in said refrigeration cycle are made fine.

6. A refrigerating/air-conditioning apparatus according to claim 5; wherein the oil drops are made minute by refining elements provided in the upstream side of the down comer.

7. A refrigerating/air-conditioning apparatus according to claim 6; wherein a size of a hole in the refining element is set to a value close to a size of maximum oil drop flowing downward so that oil drops having a size exceeding that of said maximum oil drop can not pass through the hole.

8. A refrigerating/air-conditioning apparatus based on a refrigeration cycle using refrigerating machine oil wherein a cooling medium circuit in which a compressor, a heat-source-side heat exchanger, a decompressor, and a user-side heat exchanger are connected successively for circulating a cooling medium; wherein the refrigerating/air-conditioning apparatus is configured so that a content of the refrigerating machine oil circulating through said refrigeration cycle is less than a solubility of the liquid phase cooling medium under the lowest temperature of the refrigeration cycle.

9. A refrigerating/air-conditioning apparatus according to claim 8; wherein a cooling medium circuit has a circuit for returning refrigerating machine oil separated from a cooling medium by an oil separator provided at a midpoint of a discharge pipe for a compressor to the compressor.

10. A refrigerating/air-conditioning apparatus according to claim 8; wherein a cooling medium circuit has a circuit having an oil separator provided at a midpoint of a pipe connecting an outlet of a heat-source-side heat exchanger to an inlet of a decompressor for returning refrigerating machine oil separated from a cooling medium to a compressor.

11. A refrigerating/air-conditioning apparatus according to claim 8; wherein a cooling medium circuit has a switch for inhibiting leakage of a cooling medium in an oil separator to a compressor side provided at a midpoint of an oil-returning pipe for returning refrigerating machine oil from the oil separator to the compressor.

12. A refrigerating/air-conditioning apparatus according to claim 8; wherein a solubility of refrigerating machine oil circulating through a refrigeration cycle to a liquid phase cooling medium is adjusted so as to be within a range of an allowable solubility by making higher a supercooling degree of the cooling medium at an outlet of a heat-source-side heat exchanger so that a temperature of the liquid phase cooling medium in an oil separator to which the cooling medium flowing out from the heat-source-side heat exchanger is inputted is lower than a temperature of the liquid phase cooling medium passing through a down comer in a cooling medium circuit provided in a down stream side from the oil separator.

13. A refrigerating/air-conditioning apparatus according to claim 8; wherein a content of refrigerating machine oil circulating through a refrigeration cycle is 0.8% or less in hydrofluorocarbon as a cooling medium and alkylbenzene-based oil as refrigerating machine oil.

14. A refrigerating/air-conditioning apparatus according to claim 12; wherein a temperature of a liquid phase cooling medium in an oil separator is lowered by cooling down the cooling medium by a heat exchanger provided inside the oil separator or in the upstream side from the oil separator.

15. A refrigerating/air-conditioning apparatus according to claim 8; wherein a cooling medium circuit has an oil separator as the main body having a diameter with which a flow velocity of a liquid phase cooling medium containing a cooling medium as hydrofluorocarbon and refrigerating machine oil as alkylbenzene-based oil flowing through the oil separator is made to 0.08 m/s or less.

* * * * *